US005121129A

United States Patent [19]

Lee et al.

[11] Patent Number: 5,121,129

[45] Date of Patent: Jun. 9, 1992

[54] EHF OMNIDIRECTIONAL ANTENNA

[75] Inventors: Eu-An Lee, Sunnyvale; Yeongming Hwang, Los Altos Hills; Vito J. Jakstys, Cupertino, all of Calif.

[73] Assignee: Space Systems/Loral, Inc., Palo Alto, Calif.

[21] Appl. No.: 692,805

[22] Filed: Apr. 25, 1991

Related U.S. Application Data

[63] Continuation of Ser. No. 494,035, Mar. 14, 1990, abandoned.

[51] Int. Cl.[5] ..... H01Q 19/060; H01Q 15/080

[52] U.S. Cl. ..... 343/753; 343/911 R

[58] Field of Search ..... 343/909, 911 R, 911 L, 343/753, 754, 872, 783, 784

[56] References Cited

U.S. PATENT DOCUMENTS 4,047,180 9/1977 Kuo et al. ..... 343/784
4,188,632 2/1980 Knox ..... 343/753
4,333,082 6/1982 Susman ..... 343/911 R
4,641,144 2/1987 Prickett ..... 343/911 R
4,872,019 10/1989 Chow et al. ..... 343/753

FOREIGN PATENT DOCUMENTS 1043125 9/1966 United Kingdom ..... 343/872

*Primary Examiner*—Michael C. Wimer
*Assistant Examiner*—Peter Toby Brown
*Attorney, Agent, or Firm*—Robert O. Guillot; Edward J. Radlo

[57] ABSTRACT

The EHF omnidirectional antenna system (10) includes a shaped lens (12) that is illuminated by a corrugated horn (14). The lens is disposed in the far-field of the horn and has two shaped surfaces (20 and 30) which together disperse the beam from the horn, such that a nearly uniform coverage over hemispherical coverage area is achieved at a frequency of approximately 44 GHz. The method of making the lens utilizes a surface shaping analysis to develop the shaped surfaces of the lens. A surface matching layer (44) is applied to all surfaces of the lens to reduce surface reflection.

10 Claims, 6 Drawing Sheets

EHF OMNIDIRECTIONAL ANTENNA

This is a continuation of copending application(s) Ser. No. 07/494,035 filed on Mar. 14, 1990, now abandoned.

BACKGROUND OF THE INVENTION

1. Field of the Invention

The present invention relates to high frequency antennas, and more particularly to an EHF antenna having a shaped lens that produces a nearly uniform transmission signal coverage over a hemispherical coverage area.

2. Brief Description of the Prior Art

In space vehicle communications, the telemetry, tracking, and command (TT&C) antenna provides ranging, telemetry, and command operation throughout all mission phases after launch vehicle separation. An ideal requirement for a TT&C antenna is that it be omnidirectional. Although a number of antennas have been designed to generate a nearly omnidirectional beam, there are no such antenna designs suitable for the high frequency EHF band of 40–100 GHz. In practice, an omnidirectional beam is represented by a cardioid pattern. Such a cardioid beam has been generated in lower frequency (four and six GHz) ranges by a slotted-ring antenna, wherein pattern shaping is achieved by using a multi-ring on a cylinder waveguide or by attaching a conical reflector to the waveguide structure. A single conical spiral antenna is another prior art device. However, these types of antennas are too small to successfully fabricate them in the EHF band.

The utilization of a lens to shape the transmission beam pattern of high frequency band signals is well known. U.S. Pat. No. 2,669,657, issued Feb. 16, 1954 to C. C. Cutter; U.S. Pat. No. 3,787,872, issued Jan. 22, 1974 to James F. Kauffman; and U.S. Pat. No. 4,321,604, issued Mar. 23, 1982 to James F. Ajioka; each teach devices that utilize a lens composed of a dielectric material to shape an input beam from a horn antenna. However, the teachings of each of these patents is directed to a lens that focuses a diverging beam from a horn into a parallel beam. As is described in detail hereinbelow, the present invention disburses the diverging beam from a horn antenna into a uniformly disbursed transmission signal covering a hemispherical area.

U.S. Pat. No. 3,434,146, issued Mar. 18, 1969 to L. G. Petrich teaches a dielectric disc lens that is placed in the mouth of a horn to produce a hemispherical transmission pattern. To the inventor's knowledge, it has not been possible to produce such a disc lens that is placed in the far-field of the horn for the EHF frequencies to which the present invention is adapted. Other U.S. Patents such as U.S. Pat. Nos. 2,719,230; 2,761,138; 2,795,783; 3,366,965; 3,550,147; 3,763,493; 3,848,255; 4,636,798; and 4,682,179 all teach electromagnetic lenses of various types. However, the teachings of these patents seem less material to the disclosure of the present invention than those discussed hereinabove.

SUMMARY OF THE INVENTION

The EHF omnidirectional antenna system (10) includes a shaped lens (12) that is illuminated by a corrugated horn (14). The lens is disposed in the far-field of the horn and has two shaped surfaces (20 and 30) which together disperse the beam from the horn, such that a nearly uniform coverage over a hemispherical coverage area is achieved at a frequency of approximately 44 GHz. The method of making the lens utilizes a surface shaping analysis to develop the shaped surfaces of the lens. A surface matching layer (44) is applied to all surfaces of the lens to reduce surface reflection.

It is an advantage of the present invention that it provides an EHF antenna which provides nearly uniform hemispherical coverage.

It is another advantage of the present invention that it provides an EHF antenna which includes a shaped lens in the far-field of the corrugated horn that is utilized to shape the transmitted beam.

It is a further advantage of the present invention that it provides an EHF antenna having circular polarization with improved axial ratio.

It is yet another advantage that the present invention that it provides an EHF antenna that can be modified to provide area coverage other than hemispherical coverage.

It is yet a further advantage of the present invention that it provides a method of producing a dielectric lens having shaped surfaces that are coated with a surface matching layer to reduce beam interference.

The foregoing and other features and advantages of the present invention will become apparent from the following detailed description of the preferred embodiments which make reference to the several figures of the drawing.

IN THE DRAWING

DETAILED DESCRIPTION OF THE PREFERRED EMBODIMENT

Figure 1:
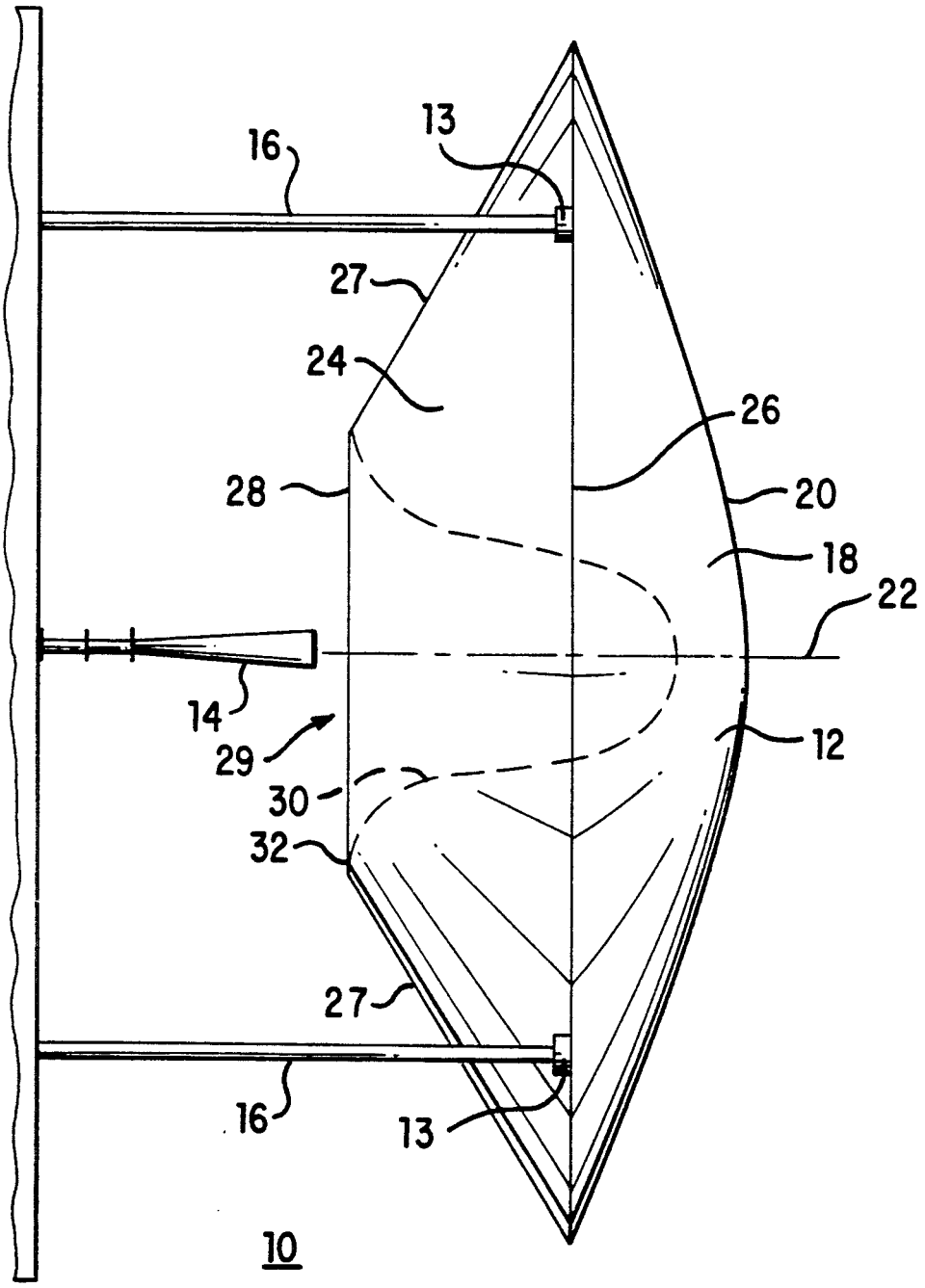
FIG. 1 is a side elevational view of the EHF omnidirectional antenna of the present invention.
Figure 2:
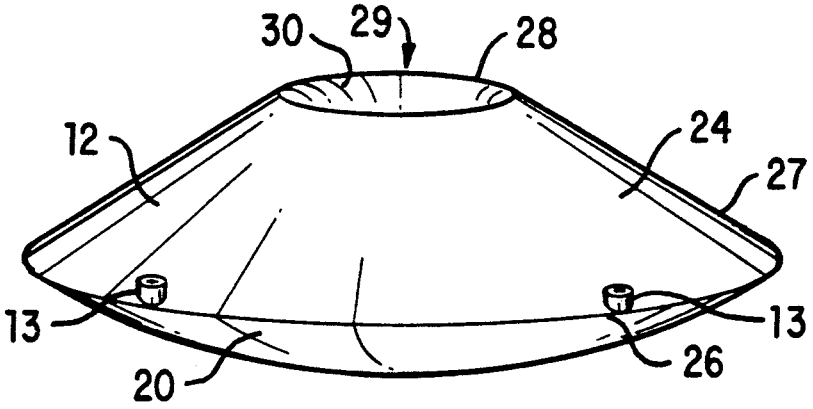
FIG. 2 is a perspective view of the lens of the present invention.
Figure 3:
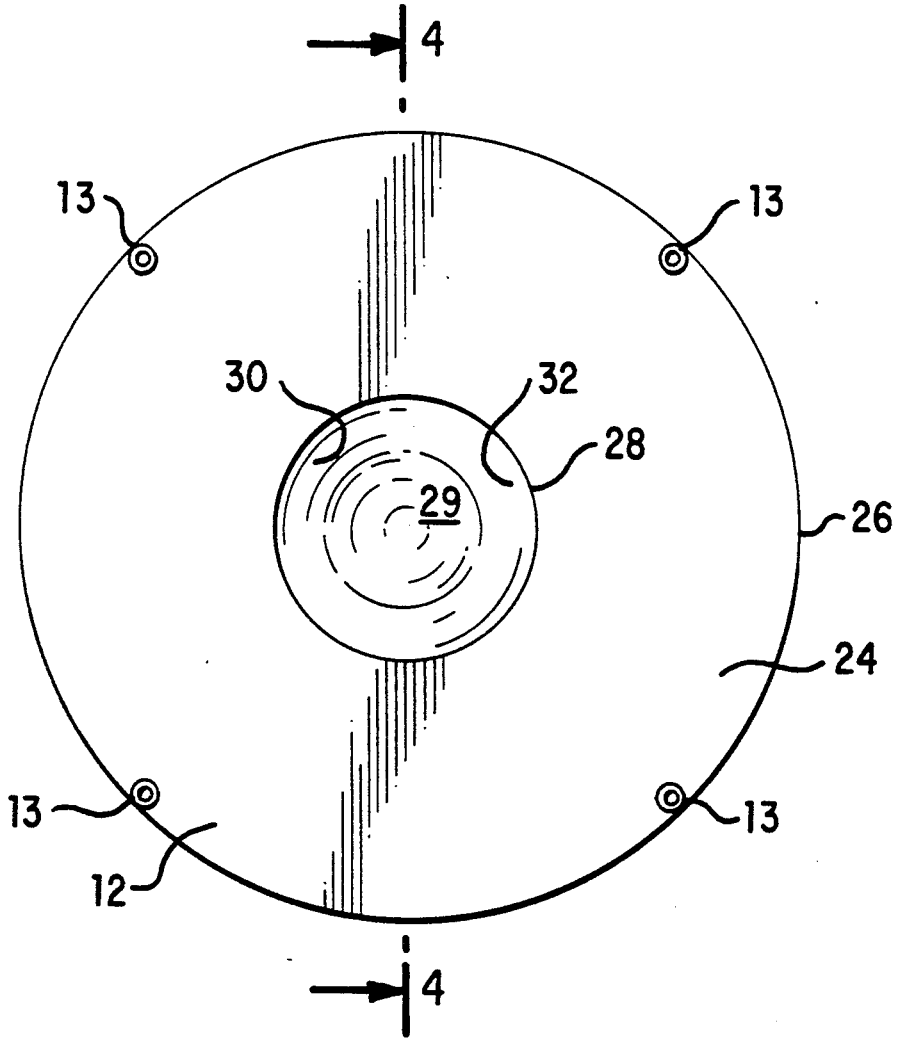
FIG. 3 is a top plan view of the lens of the present invention.

As depicted in FIGS. 1, 2 and 3, the EHF omnidirectional antenna 10 of the present invention includes a shaped lens 12 that is illuminated by a corrugated horn 14. The lens 12 has four projecting mounts 13 that engage struts 16 which hold the lens in a fixed position in front of the horn 14, such that the output signals from the horn 14 are projected through the lens 12.

The lens 12 is a generally disk-shaped body having an outer portion 18 defined by a convex outer surface 20 that is rotationally symmetrical about a central axis 22, and an inner portion 24 which is generally shaped as a truncated cone that meets with the generally convex outer portion 20 in a circular edge 26. The inner portion 24 has straight side edges 27 and is truncated at an inner edge 28 which is circular and disposed in a plane which is parallel to the plane of the edge 26.

A shaped inner cavity 29 that is defined by a cavity wall 30, is formed within the body of the lens 12. The outward lip 32 of the cavity 29 extends to meet the inner edge 28.

It is therefore to be appreciated that the lens 12 is a solid, disk-like body having a shaped cavity 29 formed therewithin. In the preferred embodiment, the lens 12 is fabricated from a dielectric material having an appropriate dielectric constant. In the preferred embodiment the dielectric material is a plastic sold under the trademark REXOLITE. It has a dielectric constant $\epsilon=2.54$. Other materials may be used having a differing dielectric constant; however, the shapes of the surfaces 20 and 30 of the lens 12 will change accordingly.

Figure 4:
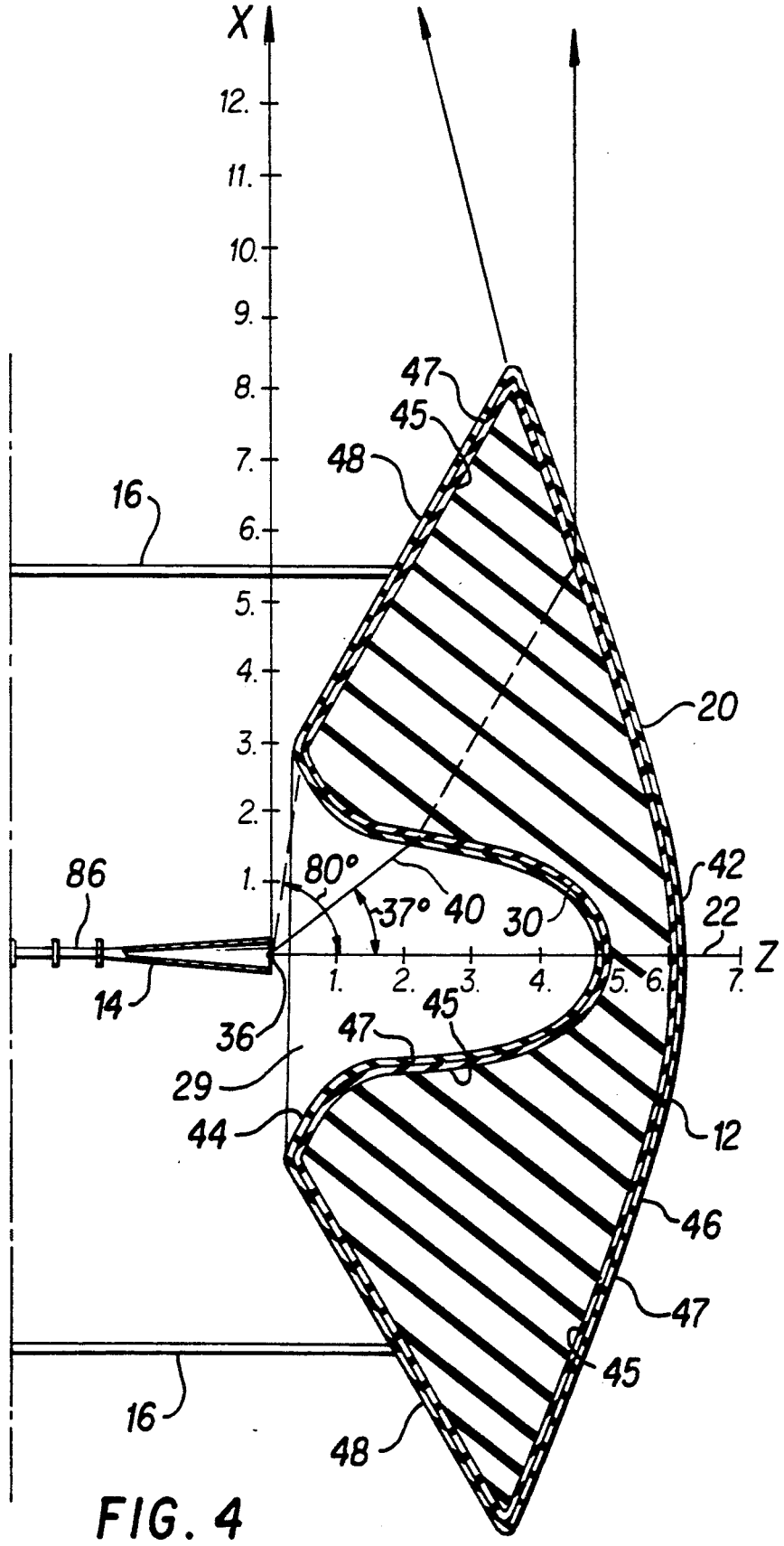
FIG. 4 is a cross-sectional view of the lens of the present invention taken along lines 4—4 of FIG. 3, and showing the lens disposed in conjunction with a horn antenna.

FIG. 4 presents a side cross-sectional view of the present invention, including a coordinate system which is useful in providing a detailed description of the inner and outer surfaces of the lens 12, together with its orientation with respect to the horn 14. As depicted in FIG. 4, an X-Z coordinate system is shown in relation to the lens 12 and horn 14, such that the origin of the coordinate system is located at the phase center 36 of the horn 14. The central axis 22 of the lens 12 as depicted in FIG. 1 corresponds to the Z axis depicted in FIG. 4.

It is significant in the present invention that the inner surface 30 of the lens 12 is located a sufficient distance from the phase center 36 of the horn 14, such that the surface 30 is disposed in the far-field of the radiation pattern from the horn 14. In this orientation, the interaction of the EHF signal from the horn with the lens is more easily understood and predicted than if the surface 30 were located in the near-field of the horn. As is well known to those skilled in the art, the far-field radiation pattern is generally taken to exist at distances greater than $2D^2/\lambda$ where D is the diameter of the aperture of the horn 14 and $\lambda$ is the wavelength of the emitted radiation. In the preferred embodiment, the diameter of the aperture of the horn 14 is 0.45 inches and the wavelength of the radiation is 0.268 inches, whereby the far-field distance is greater than 1.511 inches.

Two computer programs are utilized to determine the shapes of the inner surface 30 and outer surface 20 of the lens 12. The first computer program is a surface-shaping program that is based on the principles of energy conservation and Snell's Law. The second computer program is a field analysis computer program that is based upon the ray-tracing technique to predict the far-field radiation pattern of the antenna 10. The second program traces a ray from the phase center 36 of the horn 14 through the two lens surfaces 30 and 20. The divergence factor of the ray, associated with each ray-surface intersection, is computed and used to predict the far-field pattern of the antenna 10.

Figure 5:
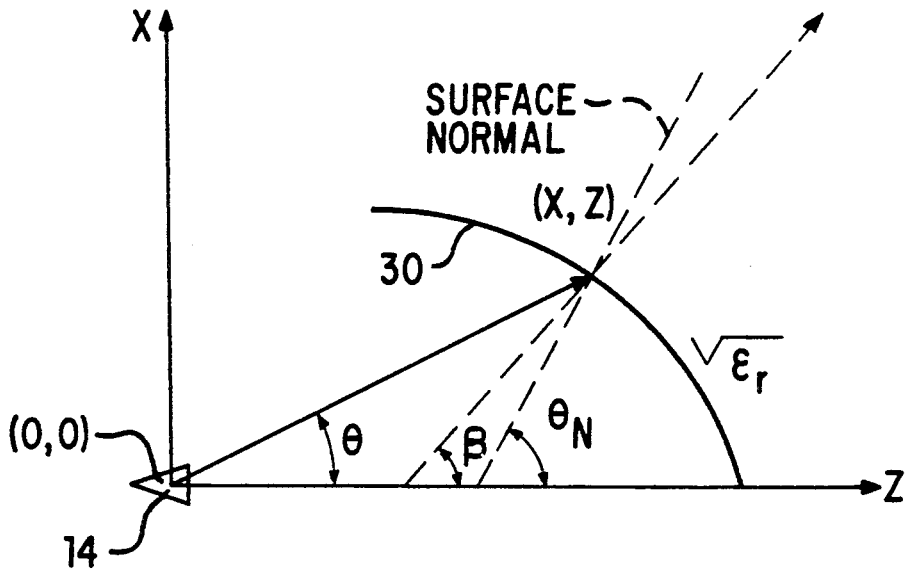
FIG. 5 is a mathematical diagram that is useful in understanding the lens surface synthesis program.

The shape of the inner surface 30 is developed first utilizing the surface-shaping program to yield a fairly uniform signal dispersion within the body 18, 24 of the lens 12. The surface shaping program is best described with the aid of FIGS. 4 and 5. FIG. 5 shows a corrugated horn 14 illuminating the lens inner surface 30. Note that the illustrated system is symmetrical about the Z axis. The total power within the increment $d\theta$ of the feed pattern $F(\theta)$ of the horn 14 will be $F(\theta)\,2\pi\sin\theta\,d\theta$. The total radiated power from $\theta=0°$ to any angle $\theta$ will then be $$\int_o^\theta F(\theta)\,2\pi\sin\theta\,d\theta$$

Similarly, the total power within the increment $d\beta$ of the lens aperture is $I(\beta)2\pi\sin\beta\,d\beta$, where $I(\beta)$ is the illumination function of the lens aperture. Again, the total power radiated from $\beta=0°$ to any angle $\beta$ will be $$\int_o^\beta I(\beta)\,2\pi\sin\beta\,d\beta$$

The energy conservation law requires that $$\int_o^\beta I(\beta)\,2\pi\sin\beta\,d\beta = \int_o^\theta F(\theta)\,2\pi\sin\theta\,d\theta \tag{1}$$

For a uniform aperture illumination, $I(\beta)=1$;Eq.(1) becomes $$\int_o^\beta \sin\beta\,d\beta = \int_o^\theta F(\theta)\sin\theta\,d\theta \tag{2}$$

We normalize equation (2) by dividing by the total power to obtain $$\frac{\int_o^\beta \sin\beta\,d\beta}{\int_o^{\beta_M} \sin\beta\,d\beta} = \frac{\int_o^\theta F(\theta)\sin\theta\,d\theta}{\int_o^{\theta_M} F(\theta)\sin\theta\,d\theta} \tag{3}$$

or $$\frac{1-\cos\beta}{1-\cos\beta_M} = \frac{\int_o^\theta F(\theta)\sin\theta\,d\theta}{\int_o^{\theta_M} F(\theta)\sin\theta\,d\theta}$$

or $$\cos\beta = 1-(1-\cos\beta_M)\cdot\frac{\int_0^\theta F(\theta)\sin\theta\,d\theta}{\int_0^{\theta_M} F(\theta)\sin\theta\,d\theta}$$

Eq.(3) relates the angle $\beta$ of the refracted ray to the angle $\theta$ of the incident ray.

Snell's law requires that $$\sin(\theta_N-\theta) = \sqrt{\epsilon_r}\,\sin(\theta_N-\beta) \tag{4}$$

where $\theta_N$ is the angle of surface normal at a point (x,z), and $\epsilon_r$ is the dielectric constant of the lens material.

Applying trigonometric relationship to both sides of Eq.(4), derives $$\tan\theta_N = \frac{\sqrt{\epsilon_r}\sin\beta - \sin\theta}{\sqrt{\epsilon_r}\cos\beta - \cos\theta} \quad (5)$$

Note that $$\frac{dX}{dZ} \cdot \tan\theta_N = -1 \quad (6)$$

and $$X = Z\tan\theta \quad (7)$$

We assume ($X_I$, $Z_I$) is the adjacent point to (X,Z). That is, $$X - X_I = dX \text{ and } Z - Z_I dZ \quad (8)$$

Applying Eq.(8) to Eq.(7), we obtain $$X_I + dX = (Z_I + dZ).\tan\theta \quad (9)$$

Note that $dZ = -\tan\theta_N.dX$ from (6), Eq. (9) becomes $$X_I + dX = (Z_I - \tan\theta_N.dX).\tan\theta$$

or $$dX = \frac{\tan\theta \cdot Z_I - X_I}{1 + \tan\theta - \tan\theta_N} \quad (10)$$

The synthesis program is based Eqs. (3), (5) and (10). The input parameters to the synthesizing program are the feed pattern $F(\theta)$, the maximum incident ray angle $\theta_M$, the maximum retracted ray angle $\beta_M$, and a starting point ($X_I$, $Z_I$).

The program works as follows:

1. For each incident angle $\theta$, the program uses Eq. (3) to compute the corresponding refracted angle $\beta$.
2. The program uses Eq. (5) to compute tan $\theta_N$.
3. The program uses Eq. (10) to compute dX.
4. The program uses Eqs. (7) and (8) to compute the point (X,Z) corresponding to the incident ray The above steps 1 to 4 are repeated for each iteration of a new incident ray at a different angle until the complete surface 30 is synthesized.

In the preferred embodiment, the shape of the inner surface 30 was determined by the surface-shaping program to be a surface of rotation which connects the points in the X-Z plane as follows:

| Z | X | Z | X |
|---|---|---|---|
| 0.0 | N/A | 3.0 | 1.66 |
| 0.5 | 2.84 | 3.5 | 1.54 |
| 1.0 | 2.21 | 4.0 | 1.35 |
| 1.5 | 1.93 | 4.5 | 1.01 |
| 2.0 | 1.81 | 5.0 | 0.00 |
| 2.5 | 1.74 | | |

Figure 6:
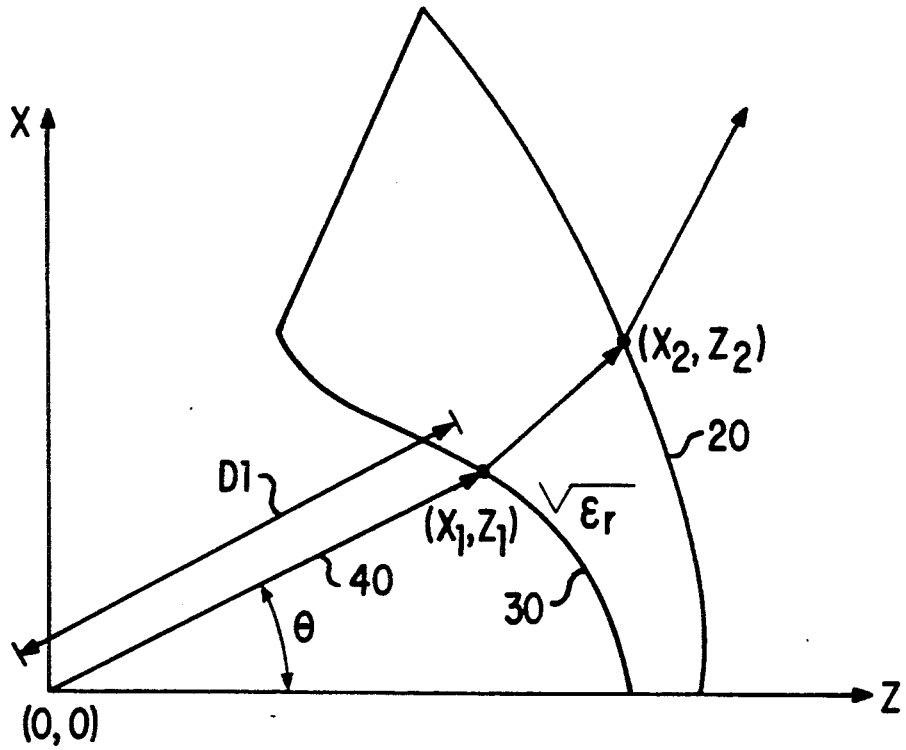
FIG. 6 is a mathematical diagram that is useful in understanding the ray tracing program.

The outer lens surface 20 is then determined by systematically changing the eccentricity of the hyperbolic curve which describes the surface 20. For each hyperbolic curve, the analysis program is exercised and the far-field pattern of the antenna 10 is predicted. The analysis program is iterated utilizing differing eccentricities until a uniform hemispherically-shaped coverage area is achieved. The ray tracing technique of the analysis program is described with the aid of FIG. 6 which is a simplification of FIG. 4.

An incident ray 40 with an incident angle $\theta$ will intersect with the lens inner surface 30 at ($X_1$,$Z_1$) and with outer surface 20 at ($X_2$,$Z_2$). The divergence factors DF1 at ($X_1$,$Z_1$) and DF2 at ($X_2$,$Z_2$) are then computed. Denoting $E_1(\theta)$ to be the incident field at the point ($X_1$,$Z_1$)

$E_{1t}(\theta)$ to be the transmitted field at the point ($X_1$,$Z_1$)

$E_2(\theta)$ to be the incident field at the point ($X_2$,$Z_2$)

and $E_{2t}(\theta)$ to be the transmitted field at the point ($X_2$,$Z_2$)

we have $$E_1(\theta) = F(\theta)/D1$$

$$E_2(\theta) = E_{1t}(\theta).DF1$$

$$E_L(\theta) = E_{2t}(\theta).DF2$$

where $F(\theta)$ is the far-field pattern of the corrugated horn, $E_L(\theta)$ is the radiated field from the lens surface, $D1 = (X_1^2 + Z_1^2)^{\frac{1}{2}}$, and the relationship between the incident and the transmitted field at each point is controlled by Snell's law.

The above technique is conceptually simple. The major complexity in coding the above steps into a program is to accurately calculate the divergence factor associated with each ray-surface intersection. A slight error in calculating the divergence factor would lead to a significant error in pattern prediction.

Figure 7:
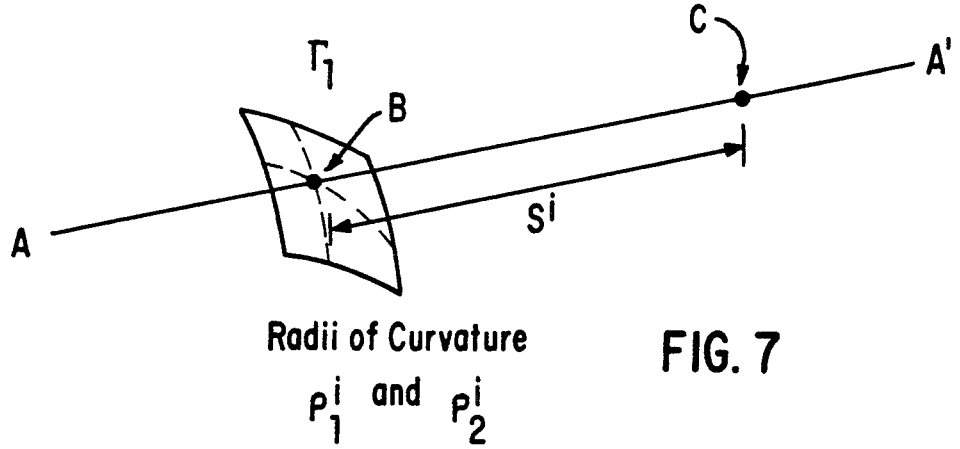
FIG. 7 is a mathematical diagram that is useful in understanding the divergence factor.

FIG. 7 illustrates how the divergence factor is defined. A ray AA' intersects a surface $\Gamma_1$ at a point B with an incident field $E_1^i$. The radii of curvature of the incident wavefront at the point B are $\rho_1^i$ and $\rho_2^i$. The field $E_2^i$ at a point C is then given by $$E_2^i = E_1^i \left[\frac{\rho_1^i \rho_2^i}{(\rho_1^i + S^i)(\rho_2^i + S^i)}\right]^{\frac{1}{2}} \exp(-jkS^i) \quad (11)$$

where $S^i$ is the distance between the point B and the point C, and k is the wave number defined by $$k = \frac{2\pi}{\lambda}.$$

The factor $$\left[\frac{\rho_1^i \rho_2^i}{(\rho_1^i + S^i)(\rho_2^i + S^i)}\right]^{\frac{1}{2}}$$

is defined as the divergence factor of the incident wavefront at the point B.

The above expression clearly indicates that it is necessary to derive $\rho_1^i$ and $\rho_2^i$ in order to compute the divergence factor.

Figure 8:
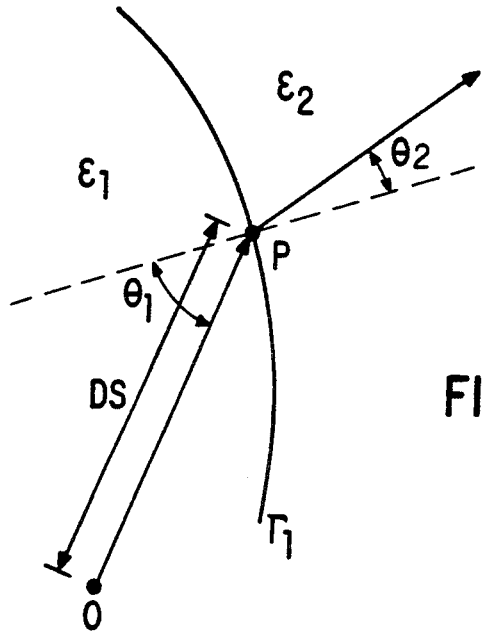
FIG. 8 is a mathematical diagram that is useful in understanding the radius of curvature of a wavefront that is transmitted through a medium.

FIG. 8 illustrates the situation for a transmitted wavefront. A ray OP emanates from a point O; intersects a surface $\Gamma_1$ at a point P. The incident angle is $\theta_1$ and the refracted angle is $\theta_2$.

According to *Geometrical Theory of Defraction for Electromagnetic Waves*, by Graeme L. James, published by Peter Peregrinus, Ltd., 1976, for the Institution of Electrical Engineers, the two radii of curvature of this incident wavefront are:

$$\rho_1^i = \frac{1}{Q_{11}}, \rho_2^i = \frac{1}{Q_{22}} \quad (12)$$

where $$Q_{11} = \left(\frac{k_1}{DS} + h \cdot C_2\right)/k_2$$

$$Q_{22} = (k_1 . \cos^2\theta_1/DS + h . C_1)/(k_2 . \cos^2\theta_2)$$

$$k_1 = \frac{2\pi}{\lambda_1}; k_2 = \frac{2\pi}{\lambda_2}$$

$$h = k_1 \cos\theta_1 - k_2 \cos\theta_2,$$

DS is the separation between the point O and the point P; and $C_1$, $C_2$ are the curvatures of the geometrical surface $\Gamma_1$ at the point P.

The surface curvatures C1, C2 at a given point can be derived analytically for a hyperboloid with equation $$\frac{Z^2}{c^2} - \frac{X^2}{a^2} - \frac{Y^2}{b^2} = 1$$

The principal curvature $C_1$, $C_2$ are given by $$C_1, C_2 = k_M \pm \sqrt{k_M^2 - k_G}$$

$$k_M = \frac{(X^2 + Y^2 + Z^2) - (c^2 - a^2 - b^2)}{2\,(abc)^2\left(\frac{X^2}{a^4} + \frac{Y^4}{b^4} + \frac{Z^2}{c^4}\right)^{3/2}}$$

and $$k_G = \frac{1}{(abc)^2\left(\frac{X^2}{a^4} + \frac{Y^2}{b^4} + \frac{Z^2}{c^4}\right)^2}$$

Figure 9:
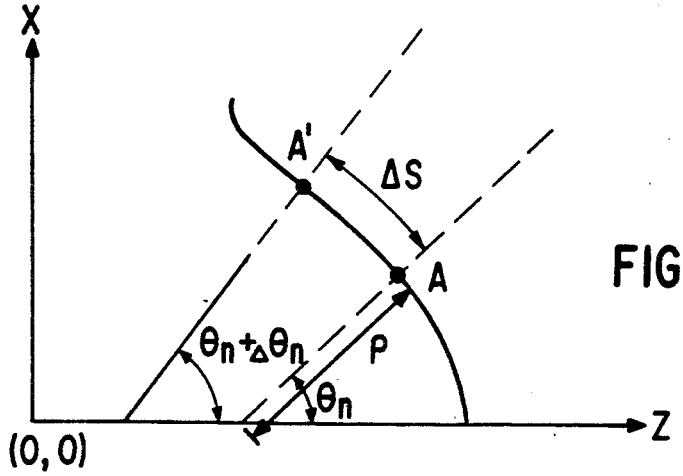
FIG. 9 is a mathematical diagram that is useful in understanding the curvature of a complex, arbitrary surface.

For a general geometrical surface, such as inner surface 30, the two principal curvatures $C_1$, $C_2$ are derived numerically as follows with the aid of FIG. 9.

$$C_1 = \lim_{\Delta S \to o} \left| \frac{\Delta\theta n}{\Delta S} \right|$$

$$C_2 = \frac{1}{\rho}$$

where $\theta_n$ is the angle of surface normal at point A, $\theta_n + \Delta\theta_n$ is the angle of surface normal at an adjacent point A', $\Delta S$ the radial distance between A and point A'.

It is important to use the correct signs for the radii of curvatures. For the radii of curvature of a wavefront, we have $\rho > o$ for diverging rays $\rho < o$ for converging rays For the radii of curvature of a geometrical surface we have $\rho > o$ for the geometry in FIG. 4 involving a convex surface $\rho < o$ for the geometry in FIG. 4 involving a concave surface It is within the skill of the ordinarily skilled artisan to develop the programming necessary to calculate $C_1$ and $C_2$ once knowledge of the shape of the inner surface 30 and the outer surface 20 is provided.

In the preferred embodiment, a suitable convex outer surface 20 of the lens 12 was determined to be a portion of a hyperboloid having an eccentricity e=2.69 and described by the following equation:

$$Z = 7 - (1 + (X/2.5)^2)^{\frac{1}{2}}$$

As depicted in FIG. 4, the inner surface 30 and outer surface interact 20 with the transmitted signal such that a ray 40 transmitted at an angle of 37 degrees from the Z axis will be refracted at the inner surface 30 and again at the outer surface 20 such that its exit angle with respect to the Z axis is 90 degrees. The maximum X-coordinate of this curve is 8.1025 inches. Therefore, the lens aperture is approximately 16 inches. The maximum subtended angle of the inner lens surface is +80 degrees as shown in FIG. 4. Any ray with the emanating angle greater than 80 degrees will directly radiate into the far-field. However, the edge taper of the feed pattern at 80 degrees is −40 dB, the interference between the direct rays and the refracted rays is negligible.

As depicted in FIG. 4, the lens inner surface is unconventionally curved. The incident angle of rays 40 to the inner surface varies from zero degrees to 50 degrees. Multiple ray reflections at all surfaces are therefore expected and such multiple ray interaction would result in pattern ripples. In order to reduce those pattern ripples, surface matching is required at all lens surfaces; i.e., the inner surface 30, the outer surface 20, and the side surfaces 27. Due to the large variation in incident angles of rays striking the inner surface 30, a matching layer with different thickness and different dielectric constant would be required in order to obtain optimum matching at each incident point. It is very difficult to fabricate such a matching layer with varying thickness and varying dielectric constant for the complex inner surface 30. However, a matching layer 44 with a constant thickness and a constant dielectric constant for a particular incident angle can still produce reasonably good matching results for a limited range of incident angles. This somewhat simplifies the matching layer design. In the preferred embodiment, a matching layer 44 is formed upon the inner surface 30 to aid in the refraction of the signal from the horn 14 through the lens 12. Additionally, a matching layer 46 is formed upon the outer surface 20 to facilitate the refraction of the signal through the lens at surface 20, and a matching layer 48 is also formed upon the side surfaces 27 of the lens 12. In the preferred embodiment, the matching layers 44, 46 and 48 are formed from a material having a dielectric constant which may range from approximately $\epsilon = 1.50$ to 1.60; the matching layer has a thickness which is at least equal to one quarter of a wavelength, which for a 44 GHz signal is approximately 0.06 inches. A material having a suitable dielectric constant was not found to be readily available. Thus, in the preferred embodiment the matching layers 44, 46 and 48 are actually formed from two layers comprising an inner layer 45 formed from Styrofoam 103.7 and an outer layer 47 composed of Duroid 5650. The Styrofoam has a dielectric constant of 1.03 and a loss tangent of 1.5. The Duroid has a dielectric constant of 2.65 and a loss tangent of 30. The thickness of each layer is approximately 0.03 inches.

Figure 10:
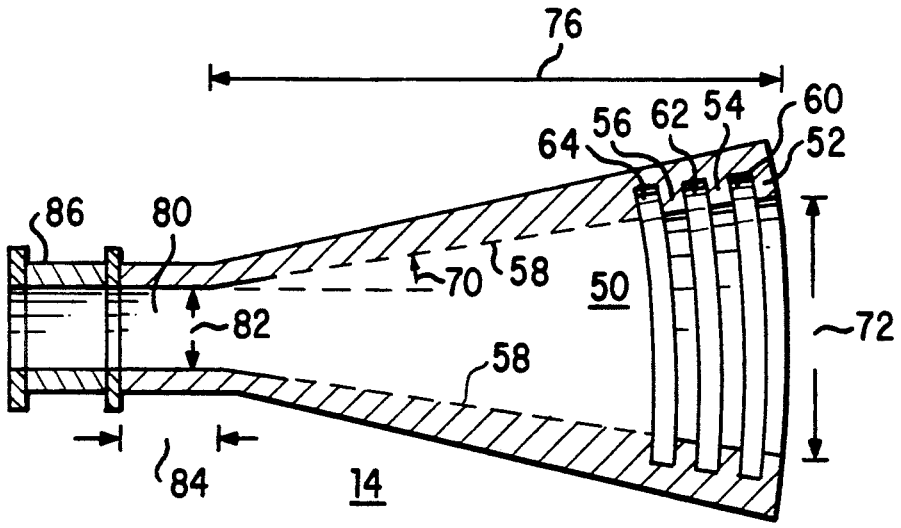
FIG. 10 is a side elevational view of a corrugated horn antenna shown in FIGS. 1 and 4 and suitable for use in the present invention.
Figure 11:
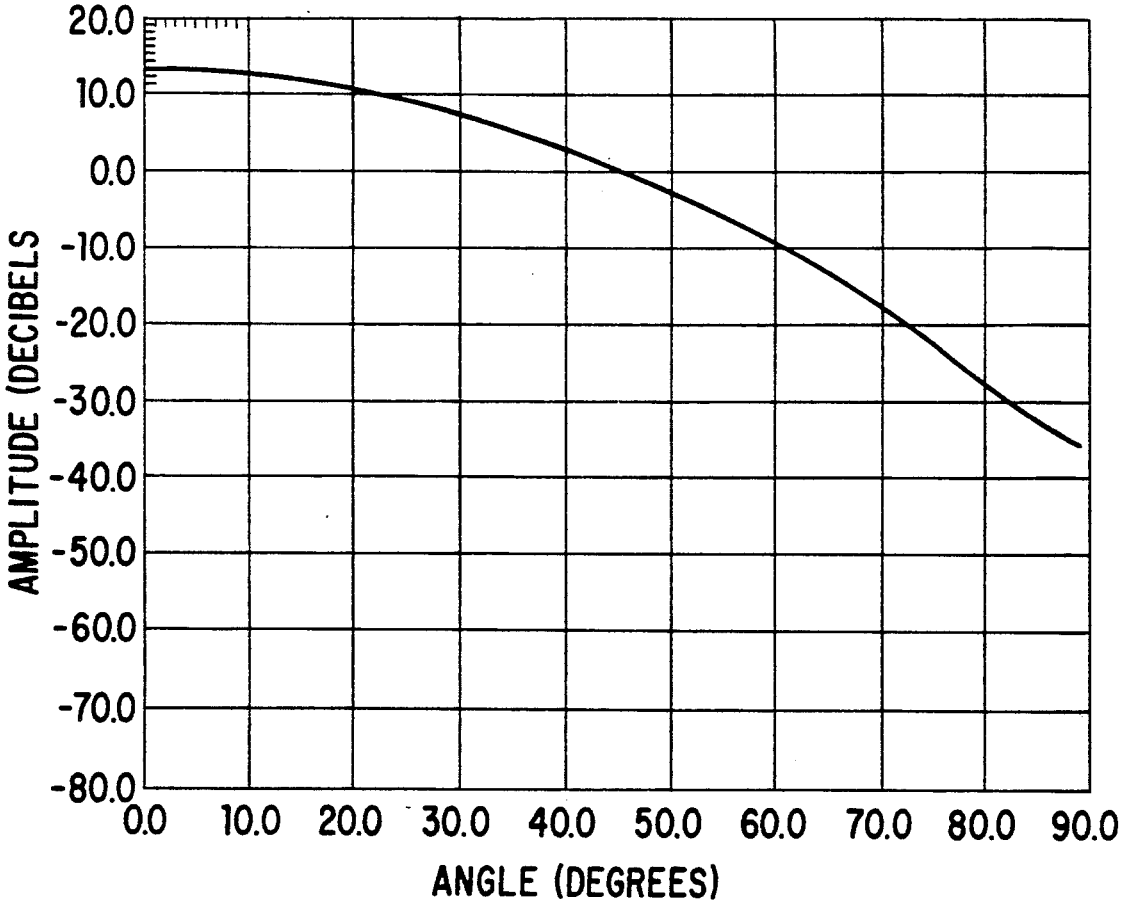
FIG. 11 depicts the far-field pattern of the horn shown in FIG. 10.

As is best seen in FIG. 10, the preferred embodiment of the horn 14 includes a corrugated inner horn surface 50. Although the horn depicted in FIG. 10 shows only three corrugations 52, 54 and 56, it is to be realized that the inner surface 50 of the horn 14 is formed with corrugation throughout its conical length as is schematically shown by the dotted lines 58. In the preferred embodiment, the corrugations, such as 52, 54 and 56, are 0.0536 inches in width, and the groove between the corrugations, such as 60, 62 and 64, is 0.0536 inches in width. corrugations is 0.069 inches. The flare angle 70 of the horn 14 is three degrees, the aperture opening 72 is 0.45 inches and the length of the flared portion 76 of the horn 14 is 2.5 inches. The throat 80 of the horn 14 has a diameter 82 of 0.188 inches and a length 84 of 0.268 inches. The far field pattern F($\theta$) of such a horn is shown in FIG. 11.

The use of corrugated horns in the transmission of EHF signals is known, and the present invention is not to be limited to the particular dimension of the corrugated horn set forth hereinabove. In the present invention, the corrugated horn 14 emits a signal shape that has nearly equal E- and H- plane patterns which are required in providing circular polarized radiation with good axial ratio.

It is desirable that the signal emitted by the horn 14 be circularly polarized. One well known method for achieving such a circular polarized signal is to pass the signal through a waveguide polarizer 86 prior to passing the signal through the corrugated horn. Another well known method is to pass the signal through the corrugated horn and then through a meanderline polarizer located at the aperture of the corrugated horn.

While the invention has been shown and described with reference to a particular preferred embodiment, it will be understood by those skilled in the art that various alterations and modifications in form and detail may be made therein. Accordingly, it is intended that the following claims cover all such alterations and modifications as may fall within the true spirit and scope of the invention.

What I claim is:

1. An EHF antenna for generating a uniform hemispherical signal comprising:

a signal generation means for transmitting an EHF signal;

a lens means, said lens means having a first surface and a second surface, and a body portion disposed between said first surface and said second surface;

said lens means being disposed away from yet proximate to said signal generation means such that signals generated by said signal generation means will pass through said first surface and through said body portion of said lens and through said second surface;

said signal generation means being disposed in a fixed orientation relative to said lens means;

said lens means functioning to create a nearly uniform hemispherical far-field distribution of the energy of said signal which passes therethrough;

wherein said first surface is a surface of rotation about a Z axis defined by the approximate coordinates, where an X axis is orthogonal to said Z axis,

| Z | X | Z | X |
|---|---|---|---|
| 0.0 | N/A | 3.0 | 1.66 |
| 0.5 | 2.84 | 3.5 | 1.54 |
| 1.0 | 2.21 | 4.0 | 1.35 |
| 1.5 | 1.93 | 4.5 | 1.01 |

-continued

| Z | X | Z | X |
|---|---|---|---|
| 2.0 | 1.81 | 5.0 | 0.00 |
| 2.5 | 1.74 | | |

2. An EHF antenna as described in claim 1, wherein said second surface is a surface of rotation about said Z axis defined by the equation $$X=7-(1+(X/2.5)^2)^{\frac{1}{2}}.$$

3. An EHF antenna as described in claim 2, wherein said lens means is composed of a material having a dielectric constant of approximately 2.54.

4. An EHF antenna for generating a uniform hemispherical signal comprising:

a signal generation means for transmitting an EHF signal;

a lens means, said lens means having a first surface and a second surface, and a body portion disposed between said first surface and said second surface;

said signal generation means being disposed in a fixed orientation relative to said lens means;

said lens means being disposed in the far-field of said signal generation means, such that signals generated by said signal generation means will pass through said first surface and through said body portion and through said second surface;

said lens means functioning to create a nearly uniform hemispherical far-field distribution of the energy of said signal which passes therethrough;

a surface matching layer being disposed upon said first surface and said second surface, wherein said first surface is a surface of rotation about a Z axis defined by the approximate coordinates, where an X axis is orthogonal to said Z axis,

| Z | X | Z | X |
|---|---|---|---|
| 0.0 | N/A | 3.0 | 1.66 |
| 0.5 | 2.84 | 3.5 | 1.54 |
| 1.0 | 2.21 | 4.0 | 1.35 |
| 1.5 | 1.93 | 4.5 | 1.01 |
| 2.0 | 1.81 | 5.0 | 0.00 |
| 2.5 | 1.74 | | |

said second surface is a surface of rotation about said Z axis defined by the equation, $$Z=7-(1+(X/2.5)^2)^{\frac{1}{2}}$$

and said lens means is composed of a material having a dielectric constant of approximately 2.54.

5. A lens for an EHF antenna for generating a uniform hemispherical signal comprising:

a first surface and a second surface and a body portion disposed between said first surface and said second surface;

a surface matching layer being disposed upon said first surface and said second surface;

said first surface being shaped to receive and refract a single EHF signal pulse such that an internal lens signal distribution is formed through said body portion;

said second surface being formed such that said internal lens signal will be refracted upon passage through said second surface to create a nearly uniform hemispherical signal in the far field of said lens;

wherein said first surface is a surface of rotation about a Z axis defined by the approximate coordinates, where an X axis is orthogonal to said Z axis,

| Z | X | Z | X |
|---|---|---|---|
| 0.0 | N/A | 3.0 | 1.66 |
| 0.5 | 2.84 | 3.5 | 1.54 |
| 1.0 | 2.21 | 4.0 | 1.35 |
| 1.5 | 1.93 | 4.5 | 1.01 |
| 2.0 | 1.81 | 5.0 | 0.00 |
| 2.5 | 1.74 | | |

and said second surface is a surface of rotation about said Z axis defined by the equation, $$Z=7-(1+(X/2.5)^2)^{178}.$$

6. A lens for an EHF antenna as described in claim 5, wherein said lens is composed of a material having a dielectric constant of approximately 2.54.

7. A method of creating a uniform hemispherical EHF signal comprising:

transmitting an EHF signal utilizing a signal generating means, said signal having a defined far-field pattern;

placing a lens means within said far-field pattern such that said EHF signal passes through said lens means;

fixedly engaging said signal generating means relative to said lens means;

forming a first surface upon said lens means such that said EHF signal passes through said first surface, said first surface being shaped such that said EHF signal is refracted by said first surface;

forming a second surface upon said lens means such that said EHF signal within said lens means is transmitted through said second surface, said second surface being shaped such that said EHF signal is refracted upon transmission through said second surface to produce a nearly uniform hemispherical EHF signal;

wherein said first surface is a surface of rotation about a Z axis defined by the approximate coordinates, where an X axis is orthogonal to said Z axis,

| Z | X | Z | X |
|---|---|---|---|
| 0.0 | N/A | 3.0 | 1.66 |
| 0.5 | 2.84 | 3.5 | 1.54 |
| 1.0 | 2.21 | 4.0 | 1.35 |
| 1.5 | 1.93 | 4.5 | 1.01 |
| 2.0 | 1.81 | 5.0 | 0.00 |
| 2.5 | 1.74 | | |

and said second surface being a surface of rotation about said Z axis defined by the equation, $$Z=7-(1+(X/2.5)^2)^{\frac{1}{2}}.$$

8. The method of manufacturing a lens for an EHF antenna to refract an EHF signal from a signal generating source, to produce a uniform hemispherical signal comprising:

determining the far-field pattern of a signal pulse from said signal generating source;

shaping a first surface of said lens utilizing said far-field pattern, such that a single signal pulse from said signal generating means will be refracted by said first surface to create an internal EHF signal distribution within a body portion of said lens;

shaping a second surface of said lens such that said internal signal will be refracted by said second surface to create a nearly uniform hemispherical EHF signal distribution at a far-field distance from said lens;

wherein said first surface is shaped as a surface of rotation about a Z axis defined by the approximate coordinates, where an X axis is orthogonal to said Z axis,

| Z | X | Z | X |
|---|---|---|---|
| 0.0 | N/A | 3.0 | 1.66 |
| 0.5 | 2.84 | 3.5 | 1.54 |
| 1.0 | 2.21 | 4.0 | 1.35 |
| 1.5 | 1.93 | 4.5 | 1.01 |
| 2.0 | 1.81 | 5.0 | 0.00 |
| 2.5 | 1.74 | | |

said second surface is shaped as a surface of rotation about said Z axis defined by the equation, $$Z=7-(1+)X/2.5)^2)^{\frac{1}{2}}$$

and said lens is composed of a material having a dielectric constant of approximately 2.54.

9. A method of manufacturing a lens described in claim 8, further including the step of attaching a surface matching layer to said first surface and said second surface.

10. A method of manufacturing a lens as described in claim 9, wherein said surface matching layer has an effective dielectric constant in the range of from 1.50 to 1.60, and said surface matching layer is formed from a plurality of layers having differing dielectric constants, said plurality of layers, in combination, functioning to create said surface matching layer having said effective dielectric constant.

* * * * *